US007648626B2

(12) United States Patent
Stell et al.

(10) Patent No.: US 7,648,626 B2
(45) Date of Patent: Jan. 19, 2010

(54) PROCESS FOR CRACKING ASPHALTENE-CONTAINING FEEDSTOCK EMPLOYING DILUTION STEAM AND WATER INJECTION

(75) Inventors: Richard C. Stell, Houston, TX (US); James N. McCoy, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 196 days.

(21) Appl. No.: 11/821,603

(22) Filed: Jun. 25, 2007

(65) Prior Publication Data

US 2008/0149532 A1 Jun. 26, 2008

Related U.S. Application Data

(63) Continuation of application No. 11/643,537, filed on Dec. 21, 2006, now abandoned.

(51) Int. Cl.
*C10G 9/12* (2006.01)
*C10G 9/36* (2006.01)

(52) U.S. Cl. ..... 208/130; 208/48 R; 208/128

(58) Field of Classification Search ..... 208/106, 208/130, 132, 48 R; 585/652
See application file for complete search history.

(56) References Cited

U.S. PATENT DOCUMENTS

| | | | |
|---|---|---|---|
| 2,289,351 | A | 7/1942 | Dixon et al. |
| 7,090,765 | B2 | 8/2006 | Spicer et al. |
| 2004/0004027 | A1 | 1/2004 | Spicer et al. |
| 2005/0261532 | A1 | 11/2005 | Stell et al. |
| 2006/0249428 | A1 | 11/2006 | Stell et al. |

*Primary Examiner*—Walter D Griffin
*Assistant Examiner*—Renee Robinson

(57) ABSTRACT

A process for reducing the rate of increase in pressure drop across a furnace convection section, the furnace convection section having a temperature profile. The process includes the steps of establishing a ratio of total dilution $H_2O$ to feedstock for the system, injecting a first portion of the total dilution $H_2O$ in the form of water into the convection section of the furnace, injecting a second portion of the dilution $H_2O$ in the form of steam into the convection section of the furnace, wherein a ratio of dilution $H_2O$ in the form of water to dilution $H_2O$ in the form of steam is established and varying the temperature profile across the convection section of the furnace by adjusting periodically the ratio of dilution $H_2O$ in the form of water to dilution $H_2O$ in the form of steam. A similar technique is conducted during decoking to remove asphaltene coke starting from the lower convection section upward. This upward decoking is accomplished by initially using more $H_2O$ in the form of water, then as the decoke proceeds reducing $H_2O$ in the form of water while increasing $H_2O$ in the form of steam.

23 Claims, 2 Drawing Sheets

PROCESS FOR CRACKING ASPHALTENE-CONTAINING FEEDSTOCK EMPLOYING DILUTION STEAM AND WATER INJECTION

CROSS REFERENCE TO RELATED APPLICATIONS

This application is a continuation of and claims priority and benefit of U.S. application Ser. No. 11/643,537, filed Dec. 21, 2006, now abandoned the disclosures of which are fully incorporated herein by reference.

FIELD OF THE INVENTION

The present invention relates to the cracking of hydrocarbons that contain relatively non-volatile hydrocarbons and other contaminants. More particularly, the present invention relates to extending the range of feedstocks available to a steam cracker.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products comprising olefins leave the pyrolysis furnace for further downstream processing, including quenching.

Olefin gas cracker furnaces are normally designed to crack ethane, propane and on occasion butane, but typically lack the flexibility to crack heavier liquid feedstocks, particularly those that produce tar in amounts greater than one percent. As gas feeds tend to produce little tar, primary, secondary, and even tertiary transfer line exchangers (TLEs) are utilized to recover energy through the generation of high pressure and medium pressure steam, as the furnace effluent cools from the furnace outlet to the quench tower inlet. The process effluent is normally then fed to a quench tower wherein the process effluent is further cooled by direct contacting with quench water.

Conventional steam cracking systems have been effective for cracking high-quality feedstocks which contain a large fraction of light volatile hydrocarbons, such as gas oil and naphtha. However, steam cracking economics sometimes favor cracking lower cost feedstocks containing resids such as, by way of non-limiting examples, atmospheric residue, e.g., atmospheric pipe still bottoms, and crude oil. Crude oil and atmospheric residue often contain high molecular weight, non-volatile components with boiling points in excess of 590° C. (1100° F.). The non-volatile components of these feedstocks may lay down as coke in the convection section of conventional pyrolysis furnaces. Only low levels of non-volatile components can be tolerated in the convection section downstream of the point where the lighter components have fully vaporized. Cracking heavier feedsthat contain non-volatiles causes convection section coking, often requiring costly shutdowns for cleaning.

Gas and steam crackers designed to operate on gaseous feedstocks, while limited in feedstock flexibility, require significantly lower investment when compared to liquid feed crackers designed for naphtha and/or heavy feedstocks that produce higher amounts of tar and byproducts. However, as may be appreciated, when the price of natural gas price is high relative to crude, gas cracking tends to be disadvantaged when compared with the cracking of virgin crudes and/or condensates, or the distilled liquid products from those feeds. (e.g., naphtha, kerosene, field natural gasoline, etc). In such an economic environment, it would be desirable to extend the range of useful feedstocks for gas fed crackers to include liquid feedstocks that contain higher levels of non-volatiles.

Advantaged steam cracking feeds frequently contain asphaltenes, which laydown as coke in the convection section of conventional pyrolysis furnaces. Contaminated condensates and full range virgin gas oils (FRVGO) with up to 400 ppm asphaltenes are typical of such advantaged feeds. However, feeds with greater than 100 ppm asphaltenes cause the thickness of the coke layer to increase rapidly in part because the coke produced by the asphaltenes typically is found within a few rows of the heat exchange tubes of the convection section. Since pressure drop is a strong function of tubing diameter, a fast growing coke layer causes the convection section pressure drop to increase rapidly. For example, a one-half inch layer of coke in a five inch diameter tube triples the pressure drop across the tube, while the same one-half inch layer of coke in a three inch diameter tube increases the pressure drop by about nine times. As such, it would be desirable to reduce the rate of increase in pressure drop across a furnace convection section to enable the use of advantaged steam cracking feeds while extending the run time between cleanings.

U.S. Pat. No. 7,090,765 proposes a process for cracking hydrocarbon feed with water substitution, the process including the steps of heating hydrocarbon feed, adding water to the heated feed, adding dilution steam to the heated feed to form a mixture, heating the resulting mixture and feeding the resulting heated mixture to the furnace, wherein the water is added in an amount of from at least about 1% to 100% based on water and dilution steam by weight. This process proposed includes a knockout pot outside the convection section that allows non volatile asphaltenes to be removed to avoid convection section fouling.

U.S. Patent Publication No. 2005/0261532 proposes a process and apparatus for removing coke formed during steam cracking of hydrocarbon feedstocks containing resides. Steam is added to the feedstock to form a mixture which is thereafter separated into a vapor phase and a liquid phase by flashing in a flash/separation vessel, separating and cracking the vapor phase, and recovering cracked product. Coking of internal surfaces in and proximally downstream of the vessel is said to be controlled by interrupting the feed flow, purging the vessel with steam, introducing an air/steam mixture to at least partially combust the coke, and resuming the feed flow when sufficient coke has been removed.

U.S. Patent Publication No. 2006/0249428 proposes a process for steam cracking heavy hydrocarbon feedstocks containing non-volatile hydrocarbons. The process includes the steps of heating the heavy hydrocarbon feedstock, mixing the heavy hydrocarbon feedstock with a fluid and/or a primary dilution steam stream to form a mixture, flashing the mixture to form a vapor phase and a liquid phase, and varying the amount of the fluid and/or the primary dilution steam stream mixed with the heavy hydrocarbon feedstock in accordance with at least one selected operating parameter of the process, such as the temperature of the flash stream before entering the flash drum.

Despite these advances in the art, there is a need for a method of reducing the rate of increase in pressure drop across a furnace convection section to enable the use of advantaged steam cracking feeds.

SUMMARY OF THE INVENTION

In one aspect, provided is a process for reducing the rate of increase in pressure drop across a furnace convection section by varying the furnace convection section tube temperature profile. The process includes the steps of establishing a ratio of total dilution $H_2O$ to feedstock for the system, injecting a first portion of the total dilution $H_2O$ in the form of substantially liquid water into the convection section of the furnace, injecting a second portion of the dilution $H_2O$ in the form of steam into the convection section of the furnace, wherein a, ratio of dilution $H_2O$ in the form of water to dilution $H_2O$ in the form of steam is established and varying the temperature profile across the, convection section of the furnace by adjusting periodically the ratio of dilution $H_2O$ in the form of water to dilution $H_2O$ in the form of steam.

In another aspect, provided is a process for cracking a hydrocarbon feed in a furnace, the furnace comprising a radiant section comprising burners that generate radiant heat and hot flue gas and a convection section comprising heat exchange tubes having a temperature profile. The process includes the steps of preheating the hydrocarbon feed in the heat exchange tubes in the convection section by indirect heat exchange with the hot flue gas from the radiant section to provide preheated feed, establishing a ratio of total dilution $H_2O$ to feedstock for the system, adding water to the preheated feed in a first sparger and then adding dilution steam to the preheated feed in a second sparger to form a feed mixture, heating the feed mixture in heat exchange tubes in the convection section by indirect heat transfer with hot flue gas from the radiant section to form a heated feed mixture, feeding the heated feed mixture to the radiant section wherein the hydrocarbon in the heated feed mixture is thermally cracked to form products and varying the temperature profile across the convection section of the furnace by adjusting periodically the ratio of dilution $H_2O$ in the form of water to dilution $H_2O$ in the form of steam.

In yet another aspect, provided is a process for decoking a furnace for cracking a hydrocarbon feed, the furnace comprising a radiant section comprising burners that generate radiant heat and hot flue gas and convection section comprising heat exchange tubes having a temperature profile. The process includes the steps of taking the furnace offline by halting the flow of hydrocarbon feed thereto, passing a decoking feed through the furnace, establishing a ratio of total dilution $H_2O$ to decoking feed, injecting a first portion of the total dilution $H_2O$ in the form of water into the convection section of the furnace, injecting a second portion of the dilution $H_2O$ in the form of steam into the convection section of the furnace, wherein a ratio of dilution $H_2O$ in the form of water to dilution $H_2O$ in the form of steam is established and varying the temperature profile across the convection section of the furnace by adjusting periodically the ratio of dilution $H_2O$ in the form of water to dilution $H_2O$ in the form of steam.

Alternatively, in yet another aspect, the process further includes the step of maintaining the ratio of total dilution $H_2O$ to feedstock for the system previously established.

Alternatively, in still yet another aspect, the first portion of the dilution $H_2O$ in the form of water is added in a first sparger and the second portion of the dilution $H_2O$ in the form of steam is added in a second sparger, wherein the first and second spargers form a sparger assembly and the first sparger is in serial fluid communication with the second sparger.

These and other features will be apparent from the detailed description taken with reference to accompanying drawings.

DETAILED DESCRIPTION OF PREFERRED EMBODIMENTS

Various aspects will now be described with reference to specific embodiments selected for purposes of illustration. It will be appreciated that the spirit and scope of the process and system disclosed herein is not limited to the selected embodiments. Moreover, it is to be noted that the figures provided herein are not drawn to any particular proportion or scale, and that many variations can be made to the illustrated embodiments. Reference is now made to the figures, wherein like numerals are used to designate like parts throughout.

When an amount, concentration, or other value or parameters, is given as a list of upper preferable values and lower preferable values, this is to be understood as specifically disclosing all ranges formed from any pair of an upper preferred value and a lower preferred value, regardless whether ranges are separately disclosed.

Feedstocks that may be employed herein may be any feedstock adapted for cracking insofar as they may be cracked into various olefins, and may contain heavy fractions such as high-boiling fractions and evaporation residuum fractions. Such feedstocks also include condensates, naphthas, and full range virgin gas oils (FRVGO). The liquid feedstocks that may be employed herein include, not only those heavy fraction-containing feedstocks adapted for cracking such as condensate, but also those having an appropriate proportion of high-quality feed stocks such as naphtha blended thereto.

Figure 1:
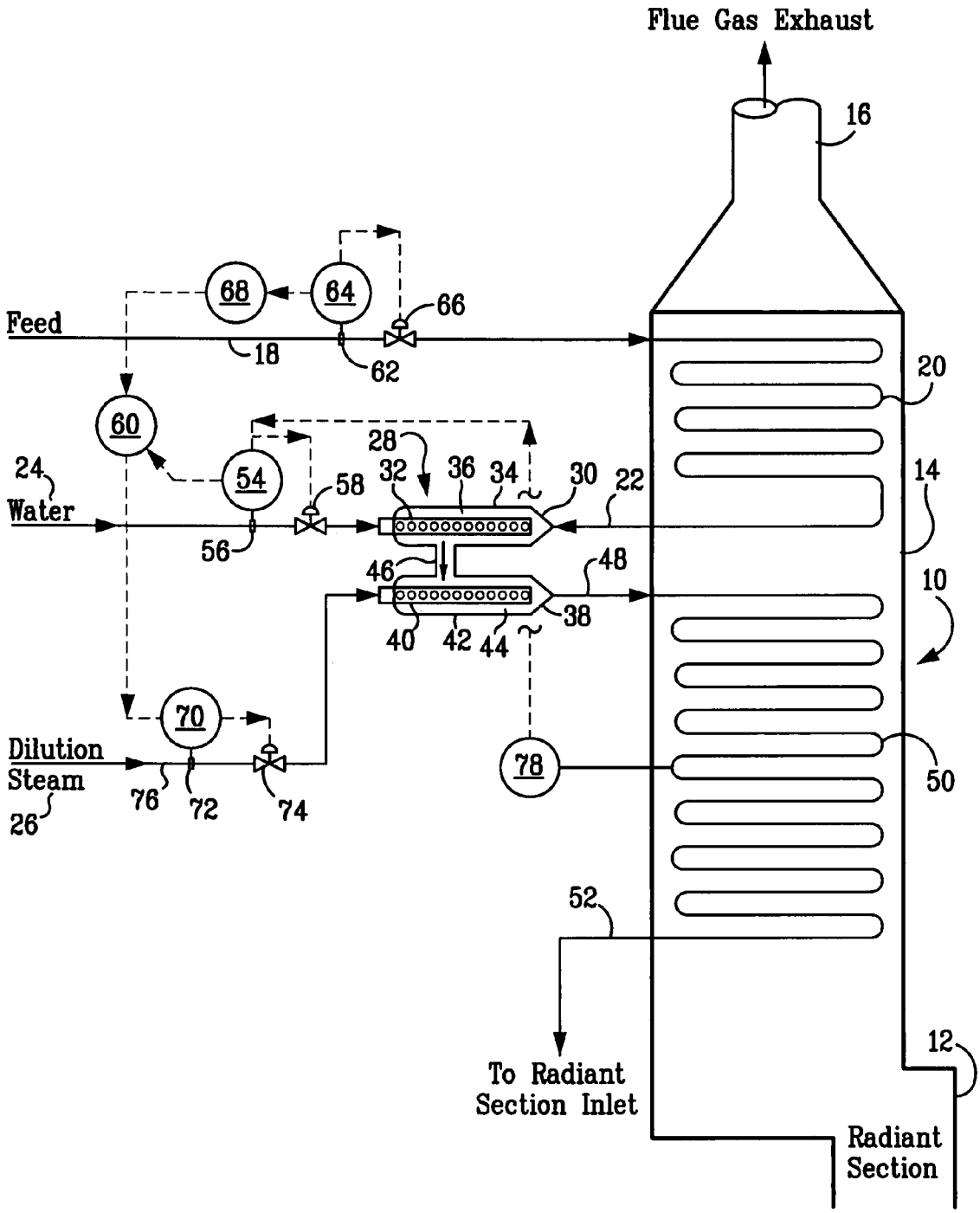
FIG. 1 illustrates an exemplary schematic flow diagram of a process as disclosed herein employed with a pyrolysis furnace, with particular emphasis on the convection section of the furnace. This figure also illustrates an optional control schematic for varying the ratio of water to dilution steam according to a process variable.

Referring now to FIG. 1, a pyrolysis furnace 10 includes a lower radiant section 12, an intermediate convection section 14, and an upper flue gas exhaust section 16. In the radiant section 12, radiant burners (not shown) provide radiant heat to a hydrocarbon feed to produce the desired products by thermal cracking of the feed. The burners generate hot gas that flows upwardly through convection section 14 and then out of the furnace 10 through flue gas exhaust section 16.

As shown in FIG. 1, hydrocarbon feed 18 enters an upper portion of the convection section 14 where it is preheated. The preheating of the hydrocarbon feed can take any form known by those of ordinary skill in the art. Generally, the heating includes indirect contact of the feed 18 in the upper convection section 14 of the furnace 10 with hot flue gases from the radiant section 12 of the furnace 10. This can be accomplished, by way of non-limiting example, by passing the feed 18 through heat exchange tubes 20 located within the convection section 14 of the furnace 10. The preheated feed 22 has a temperature between about 200 to about 600° F. (about 95 to about 315° C.) or about 300 to about 500° F. (about 150 to about 260° C.) or between about 350 to about 500° F. (about 175 to about 260° C.).

In one form, provided is a process for cracking a hydrocarbon feed 18 in a furnace 10, the furnace 10 comprising a radiant section 12 including burners (not shown) that generate radiant heat and hot flue gas and a convection section 14 comprising heat exchange tubes 20 having a temperature profile. The process includes the steps of preheating the hydrocarbon feed 18 in the heat exchange tubes 20 in the convection section 14 by indirect heat exchange with the hot flue gas from the radiant section 12 to provide preheated feed 22, establishing a ratio of total dilution $H_2O$ to feedstock 18 for the system through the convection section, adding water to the preheated feed 22 in a first sparger and then adding dilution steam to the preheated feed in a second sparger to form a feed mixture, heating the feed mixture in heat exchange tubes 20 in the convection section 14 by indirect heat transfer with hot flue gas from the radiant section 12 to form a heated feed mixture, feeding the heated feed mixture to the radiant section 12 wherein the hydrocarbon in the heated feed mixture is thermally cracked to form products and varying the temperature profile across the convection section 14 of the furnace 10 by adjusting periodically the ratio of dilution $H_2O$ in the form of water to dilution $H_2O$ in the form of steam. Preferably, the water to steam ratio is adjusted periodically, meaning broadly that the ratio is adjusted in any desired manner, such as continuously, stepwise, incrementally, at regular or irregular intervals, on a linear or non-linear curve, or combinations thereof.

The process disclosed herein utilizes the heat sink provided by the relatively high heat of vaporization of water (40.65 kJ/mol) and its impact on the convection section temperature profile when the ratio of dilution $H_2O$ in the form of water to dilution $H_2O$ in the form of steam is varied. By "water" is meant liquid water, low quality steam, and mixtures of water and low quality steam. By "low quality steam" is meant steam having a quality of ≦40% (≦40% of the steam mass is vapor). By "steam" is meant high quality steam. By "high quality steam" is meant steam having a quality of ≧70% (≧70% of the steam mass is vapor).

As may be appreciated by those skilled in the art, advantaged steam cracking feeds 18 frequently contain asphaltenes, which can and often do lay down as coke in the convection section 14 as feed/steam mixture reaches its dry point. Contaminated condensates and full range VGOs (FRVGO) with up to 400 ppm asphaltenes are typical of such advantaged feeds 18. Feeds 18 with greater than 100 ppm asphaltenes can cause the thickness of the coke layer to increase rapidly, in part because the coke produced by the asphaltenes typically is found within only about five rows of heat exchange tubes 20 of convection section 14. Since pressure drop is a function of tubing diameter to the $-5^{th}$ power, a fast growing coke layer causes the convection section pressure drop to increase rapidly. For example, a one-half inch layer of coke in a five inch diameter tube triples the pressure drop across the tube, while the same one-half inch layer of coke in a three inch diameter tube increases the pressure drop by nine times.

To reduce the rate of impact of convection section 14 coke build-up on pressure drop, it is desirable to spread the coke build-up over more rows of heat exchange tubes 20 of convection section 14, so that the thickness of the coke layer over a period of time is reduced as compared to deposition in a concentrated region. It should be noted that the total weight of the coke that builds up within heat exchange tubes 20 of convection section 14 over time is about the same.

As indicated, typically, coke lays down over a few of the rows of tubes, such as about five rows of heat exchange tubes 20 of convection section 14 when processing a non-volatile contaminated FRVGO. By spreading the same amount of coke over more rows, such as about ten rows of five inch diameter heat exchange tubes 20 of convection section 14, rather than five rows, the pressure drop is reduced by about 20%. To spread the same amount of coke over ten rows of three inch diameter tubes, rather than five rows, the pressure drop is reduced by about 50%. As may be appreciated by those skilled in the art, the pressure drop reduction that results from the thinner coke layer in the original five rows of heat exchange tubes 20 of convection section 14 is greater than the increased pressure drop in the additional five rows of heat exchange tubes 20 of convection section 14.

As disclosed herein, it has been found that coke build-up can be spread over more rows of heat exchange tubes 20 of convection section 14 by either raising or lowering the dry point temperature of the steam/feed mixture or by changing the process temperature profile in the convection section. As indicated, spreading the coke build-up over more rows of heat exchange tubes 20 of convection section 14 reduces pressure drop, extending the run length of a furnace. Of course, this means the convection section 14 will have more total coke build up over this extending period of operation. Although larger volumes of convection coke that spalls during steam/air decoking can plug inlet manifolds and radiant tube critical flow nozzles, the processes disclosed herein also tend to mitigate the likelihood of plugging.

As such, in one form, provided is a process for reducing the rate of increase in pressure drop across a furnace convection section 14, the furnace convection section 14 having a temperature profile. The process includes the steps of establishing a ratio of total dilution $H_2O$ to feedstock 18 for the system, injecting a first portion of the total dilution $H_2O$ in the form of water into the convection section 14 of the furnace 10, injecting a second portion of the dilution $H_2O$ in the form of steam into the convection section 14 of the furnace 10, wherein a ratio of dilution $H_2O$ in the form of water to dilution $H_2O$ in the form of steam is established and varying the temperature profile across the convection section 14 of the furnace 10 by adjusting periodically the ratio of dilution $H_2O$ in the form of water to dilution $H_2O$ in the form of steam.

As disclosed herein, increasing dilution water serves to provide a continually increasing heat sink by utilizing the large heat of vaporization of water. Thus, downstream of the water injection, the process temperature at any point in the convection section 14 decreases as the run processes. Or equivalently, the location where a given temperature is reached, such as the steam/feed mixture dry point, moves or is adjusted down through the convection section 14.

For example, at a steam to hydrocarbon ratio of 0.35, progressively replacing all of the dilution steam with water provides about a 230 Btu/lb heat sink. Given a mixture $C_p$ of about 0.8, the heat sink is equivalent to about 300° F. of sensible heat. Furnace simulations have shown that 300° F. will move the dry point down the convection section 14 by six to seven rows of heat exchange tubes 20 of convection section 14. Since coke laydown occurs at or near the dry point, this steam/water swap spreads the asphaltene-based coke over more than twice as many rows of heat exchange tubes 20 of convection section 14. In systems employing three inch tubing, this steam/water swap reduces the pressure drop associated with coke build-up by greater than 50%.

A process run may be started at either maximum or minimum dilution water. Since the flue gas is coolest at the start of a process run, maximum water may allow asphaltenes to laydown as coke at the lowest location in the convection section 14. However, because coke is a good insulator, in spite of the higher flue gas temperature at the end of, a run, the process temperature may be lower at a given point in the convection section 14.

As may be appreciated, adding dilution water simultaneously reduces furnace capacity, while increasing ethylene selectivity and furnace efficiency. Replacing steam with water also reduces the crossover temperature (XOT), which increases the radiant duty at a given feed rate. If the furnace is already at maximum firing, then the feed rate must be reduced, producing a capacity debit. However, a lower XOT reduces unselective crossover cracking (particularly for FRVGO), which increases the ethylene produced, producing a capacity credit. Thus, ethylene capacity may not change. If dilution water is added with the feed at the top of the convection section, then as the water boils, the inside heat transfer coefficient and the log mean temperature difference (LMTD or $\Delta T_{lm}$) will increase. This reduces the stack temperature and increases furnace efficiency. In addition, incremental dilution steam does not need to be produced elsewhere in the plant, an additional energy credit.

As may be appreciated, dilution water can come from multiple sources and can be introduced from at least two locations. Dilution water can be provided from a source of process steam condensate or boiler feed water or a combination thereof. If process steam condensate is used as the source, then the convection section 14 must be capable of tolerating the potential corrosion associated with the lower pH of such a source. Dilution water can be added with the feed 18 through a sparger, such as sparger assembly 30, described hereinbelow, with the dilution steam. In one form, water is added through a sparger, such as sparger assembly 30, before the steam to ensure that the steam does not vaporize all of the feed 18, causing asphaltenes to laydown as coke in a short length of convection section heater exchanger tubes.

As disclosed herein, after the preheated hydrocarbon feed 18 exits the convection section 14 at 22, water 24 and dilution steam 26 are added thereto to form a mixture. Water 24 is added to the preheated feed 18 in an amount of from at least about 0% to about 100% based on the total amount of water 24 and dilution steam 26 added by weight; or an amount of at least about 3% to about 100% based on the total amount of water 24 and dilution steam 26 by weight; or at least about 10% based on the total amount of water 24 and dilution steam 26 added by weight; or at least about 30% based on water 24 and dilution steam 26 by weight. It is understood that, in accordance with one form, 100% water could be added to the hydrocarbon feed 18 such that no dilution steam is added. The sum of the added water flow and added dilution steam flow provides the total desired reaction zone $H_2O$.

As shown in FIG. 1, water 24 may be added to the preheated feed 22 prior to addition of dilution steam 26. It is believed that this order of addition may be preferred and may reduce undesirable pressure fluctuations in the process stream originating from mixing the hydrocarbon feed 22, water 24 and dilution steam 26. As may be appreciated by those skilled in the art, such fluctuations are commonly referred to as a water-hammer or steam-hammer. While the addition of water 24 and dilution steam 26 to the preheated hydrocarbon feed 22 could be accomplished using any known mixing device, it may be preferred to use a sparger assembly 28, such as illustrated in greater detail in FIG. 2. Water 24 is preferably added in a first sparger 30. As shown, first sparger 30 comprises an inner perforated conduit 32 surrounded by an outer conduit 34 so as to form an annular flow space 36 between the inner and outer conduits 32 and 34, respectively. As shown, the preheated hydrocarbon feed 22 flows through the annular flow space 36. Also preferably, water 24 flows through the inner perforated conduit 32 and is injected into the preheated hydrocarbon feed 22 through the openings (perforations) shown in inner conduit 32.

Dilution steam 26 may be added to the preheated hydrocarbon feed 22 in a second sparger 38. As shown, second sparger 38 includes an inner perforated conduit 40 surrounded by an outer conduit 42 so as to form an annular flow space 44 between the inner and outer conduits 40 and 42, respectively. The preheated hydrocarbon feed 22 to which the water 24 has been added flows through the annular flow space 44. Thereafter, dilution steam 26 flows through the inner perforated conduit 40 and is injected into the preheated hydrocarbon feed 22 through the openings (perforations) shown in inner conduit 40.

Figure 2:
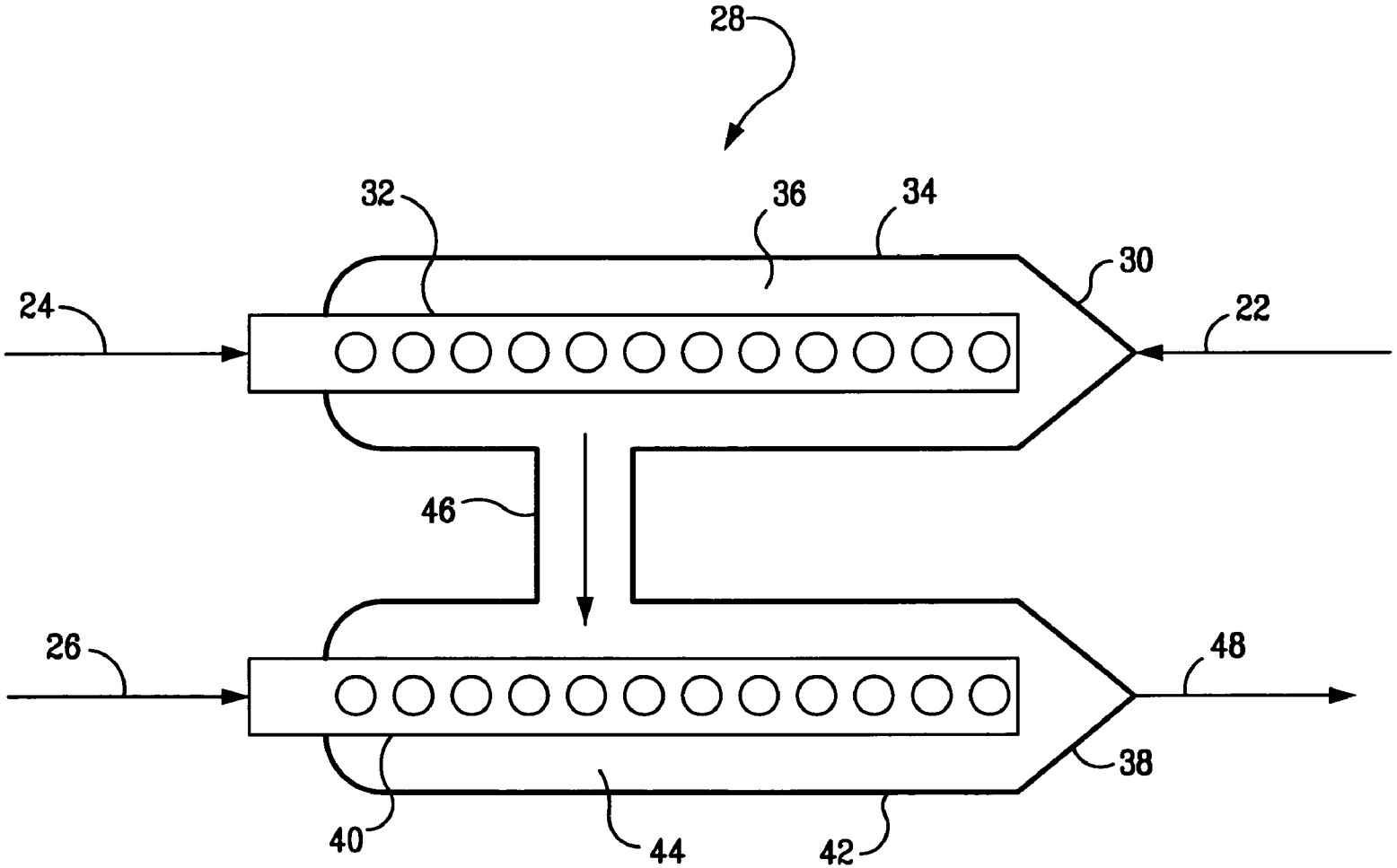
FIG. 2 presents an exemplary schematic diagram of a dual sparger of the type disclosed herein.

In another form, the first and second spargers 30 and 38, respectively, are part of a sparger assembly 28, as shown, in which the first and second spargers 30 and 38, respectively, are connected in fluid flow communication (46) in series. As shown in FIGS. 1 and 2, the first and second spargers 30 and 38 are interconnected in fluid flow communication in series by fluid flow interconnector 46.

As further illustrated in the drawings, upon exiting the sparger assembly 28, the mixture 48 (of hydrocarbon feed 22, water 24 and dilution steam 26) flows back into furnace 10 wherein the mixture 48 is further heated, preferably in a lower portion of convection section 14. The further heating of the hydrocarbon feed can take any form known by those of ordinary skill in the art. The further heating may include indirect contact of the feed in the lower convection section 14 of the furnace 10 with hot flue gases from the radiant section 12 of the furnace. This can be accomplished, by way of non-limiting example, by passing the feed through heat exchange tubes 50 located within the convection section 14 of the furnace 10. Following the additional heating of the mixture at 50, the resulting heated mixture exits the convection section at 52 and then flows to the radiant section of the furnace for thermal cracking of the hydrocarbon. The heated feed to the radiant section preferably may have a temperature between about 800 to about 1400° F. (about 425 to about 760° C.) or about 1050 to about 1350° F. (about 560 to about 730° C.).

In yet another form, provided is a process for decoking a furnace 10 for cracking a hydrocarbon feed 18, the furnace 10 comprising a radiant section 12 comprising burners (not shown) that generate radiant heat and hot flue gas and convection section 14 comprising heat exchange tubes 20 having a temperature profile. The process includes the steps of taking the furnace 10 offline by halting the flow of hydrocarbon feed 18 thereto, passing a decoking feed (typically air) through the furnace, 10 establishing a ratio of total dilution $H_2O$ to decoking feed, injecting a first portion of the total dilution $H_2O$ in the form of water into the convection section of the furnace, injecting a second portion of the dilution $H_2O$ in the form of steam into the convection section of the furnace, wherein a ratio of dilution $H_2O$ in the form of water to dilution $H_2O$ in the form of steam is established and varying the temperature profile across the convection section of the furnace by adjusting periodically the ratio of dilution $H_2O$ in the form of water to dilution $H_2O$ in the form of steam.

As disclosed herein, swapping water for dilution steam during steam/air decoking reduces or eliminates plugging of the inlet manifold and critical flow nozzles (also known as venturis or CFNs) by allowing selective coke spalling to occur. Selective spalling can occur by progressively reducing the amount of dilution water during a decoke operation. At maximum water, only the coke lowest in the convection section 14 would be hot enough to burn. Thus, only a relatively small volume of the coke could spall. As may be appreciated by those skilled in the art, this coke would burn and pass through the through the CFNs. As the decoke progresses steam replaces water allowing combustion to occur higher in the convection section. Again only relatively small volume of coke spalls. Varying the $H_2O$/air ratio during the decoke can be employed in tandem with varying the water/steam ratio to selectively burn and spall the larger volume of convection coke inherent with the processes disclosed herein.

FIG. 1 further illustrates an optional control system having utility in the processes disclosed herein. The process temperature provides an input to a controller 54 which controls the flow rate of water via a flow meter 56 and a control valve 58. The water then enters the sparger assembly 28. When the process temperature is too high, controller 54 increases the flow of water 24.

Controller 54 also sends the flow rate signal to a computer control application schematically shown at 60, which determines the dilution steam flow rate as detailed below. A pre-set flow rate of the hydrocarbon feed 18 is measured by flow meter 62, which is an input to controller 64, which in turn sends a signal to feed control valve 66. Controller 64 also sends the feed rate signal to a computer control application 68, which determines the total $H_2O$ to the radiant section 12 by multiplying the feed rate by a pre-set total $H_2O$ to feed rate ratio. The total $H_2O$ rate signal is the second input to computer application 60. Computer application 60 subtracts the water flow rate from the total $H_2O$ rate; the difference is the set point for the dilution steam controller 70. Flow meter 72 measures the dilution steam (26) rate, which is also an input to the controller 70. When water flow rate increases, as discussed above, the set point that is input to the dilution steam controller 70 decreases. Controller 70 then instructs control valve 74 to reduce the dilution steam rate 76 to the new set point. When the process temperature 78 is too low the control scheme instructs control valve 58 to reduce water rate and instructs control valve 74 to increase the steam rate while maintaining constant total $H_2O$ rate.

As may be appreciated by those skilled in the art, the optional control system described hereinabove is not required since process simulation tools may be employed to predict the temperatures rather than measuring them.

All patents, test procedures, and other documents cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

What is claimed is:

1. A process for reducing the rate of increase in pressure drop across a furnace convection section, the furnace convection section having a temperature profile, said process comprising the steps of:

(a) establishing a ratio of total dilution $H_2O$ to feedstock for the system;

(b) injecting a first portion of the total dilution $H_2O$ in the form of water into the convection section of the furnace;

(c) injecting a second portion of the dilution $H_2O$ in the form of steam into the convection section of the furnace, wherein a ratio of dilution $H_2O$ in the form of water to dilution $H_2O$ in the form of steam is established;

(d) monitoring the temperature profile across the convection section of the furnace; and (e) varying the temperature profile across the convection section of the furnace by adjusting the ratio of dilution $H_2O$ in the form of water to dilution $H_2O$ in the form of steam so as to spread coke build-up over additional rows of heat exchange tubes in the convection section, and reduce the rate of pressure drop across the convection section.

2. The process of claim 1, further comprising the step of maintaining the ratio of total dilution $H_2O$ to feedstock for the system established in step (a) while injecting the water and steam.

3. The process of claim 1, wherein the first portion of the dilution $H_2O$ in the form of water is added in a first sparger.

4. The process of claim 3, wherein the second portion of the dilution $H_2O$ in the form of steam is added in a second sparger.

5. The process of claim 4, wherein the first and second spargers form a sparger assembly wherein the first sparger is in serial fluid communication with the second sparger.

6. The process of claim 5, wherein the furnace is a steam cracking furnace.

7. The process of claim 1, wherein the furnace is a steam cracking furnace.

8. The process of claim 1, wherein the first portion of the dilution $H_2O$ in the form of water is added in an amount of between 0% to 100% by weight of the total dilution $H_2O$.

9. The process of claim 1, wherein the first portion of the dilution $H_2O$ in the form of water is added in an amount of at least about 30% by weight of the total dilution $H_2O$.

10. A process for cracking hydrocarbon feed in a furnace, the furnace comprising a radiant section comprising burners that generate radiant heat and hot flue gas and a convection section comprising heat exchange tubes having a temperature profile, the process comprising the steps of:

(a) preheating the hydrocarbon feed in the heat exchange tubes in the convection section by indirect heat exchange with the hot flue gas from the radiant section to provide preheated feed;

(b) establishing a ratio of total dilution $H_2O$ to feedstock for the system;

(c) adding water to the preheated feed in a first sparger and then adding dilution steam to the preheated feed in a second sparger to form a feed mixture;

(d) heating the feed mixture in heat exchange tubes in the convection section by indirect heat transfer with hot flue gas from the radiant section to form a heated feed mixture;

(e) feeding the heated feed mixture to the radiant section wherein the hydrocarbon in the heated feed mixture is thermally cracked to form products;

(f) monitoring the temperature profile across the convection section of the furnace; and (g) varying the temperature profile across the convection section of the furnace by adjusting periodically the ratio of dilution $H_2O$ in the form of water to dilution $H_2O$ in the form of steam so as to spread coke build-up over additional rows of heat exchange tubes in the convection section, and reduce the rate of pressure drop across the convection section.

11. The process of claim 10, wherein the first sparger comprises an inner perforated conduit surrounded by an outer conduit so as to form an annular flow space between the inner and outer conduits.

12. The process of claim 11, comprising the step of flowing the preheated hydrocarbon feed through the annular flow space and flowing the water through the inner conduit and injecting the water into the preheated hydrocarbon feed through the openings in the inner conduit.

13. The process of claim 12, wherein the second sparger comprises an inner perforated conduit surrounded by an outer conduit so as to form an annular flow space between the inner and outer conduits.

14. The process of claim 13, comprising the step of flowing the feed from the first sparger through the annular flow space and flowing the dilution steam through the inner conduit and injecting the dilution steam into the feed through the openings in the inner conduit.

15. The process of claim 10, wherein the first and second spargers are part of a sparger assembly in which the first and second spargers are connected in fluid flow communication in series.

16. A process for decoking a furnace for cracking a hydrocarbon feed, the furnace comprising a radiant section comprising burners that generate radiant heat and hot flue gas and a convection section comprising heat exchange tubes having a temperature profile, the process comprising the steps of:

(a) taking the furnace offline by halting the flow of hydrocarbon feed thereto;

(b) passing a decoking feed through the furnace;

(c) establishing a ratio of total dilution $H_2O$ to decoking feed;

(d) injecting a first portion of the total dilution $H_2O$ in the form of water into the convection section of the furnace;

(e) injecting a second portion of the dilution $H_2O$ in the form of steam into the convection section of the furnace, wherein a ratio of dilution $H_2O$ in the form of water to dilution $H_2O$ in the form of steam is established;

(f) monitoring the temperature profile across the convection section of the furnace; and (g) varying the temperature profile across the convection section of the furnace by adjusting periodically the ratio of dilution $H_2O$ in the form of water to dilution $H_2O$ in the form of steam to selectively effect coke spalling and combustion from lower portions of the convection section to higher portions of the convection section.

17. The process of claim 16, wherein the decoking feed is air.

18. The process of claim 16, further comprising the step of maintaining the ratio of total dilution $H_2O$ to feedstock for the system established in step (c) while injecting the water and steam.

19. The process of claim 16, wherein the first portion of the dilution $H_2O$ in the form of water is added in a first sparger.

20. The process of claim 19, wherein the second portion of the dilution $H_2O$ in the form of steam is added in a second sparger.

21. The process of claim 20, wherein the first and second spargers form a sparger assembly wherein the first sparger is in serial fluid communication with the second sparger.

22. The process of claim 16, wherein the furnace is a steam cracking furnace.

23. The process of claim 16, wherein the first portion of the dilution $H_2O$ in the form of water is added in an amount of between 0% to 100% by weight of the total dilution $H_2O$.

* * * * *